US009879493B2

(12) United States Patent
Berger

(10) Patent No.: US 9,879,493 B2
(45) Date of Patent: Jan. 30, 2018

(54) INTELLIGENT CORING SYSTEM

(71) Applicant: COREALL AS, Kolltveit (NO)

(72) Inventor: Per Erik Berger, Kolltveit (NO)

(73) Assignee: COREALL AS, Kolltveit (NO)

( * ) Notice: Subject to any disclaimer, the term of this patent is extended or adjusted under 35 U.S.C. 154(b) by 339 days.

(21) Appl. No.: 14/415,350

(22) PCT Filed: Jul. 1, 2013

(86) PCT No.: PCT/EP2013/063867
§ 371 (c)(1),
(2) Date: Jan. 16, 2015

(87) PCT Pub. No.: WO2014/012781
PCT Pub. Date: Jan. 23, 2014

(65) Prior Publication Data

US 2015/0191985 A1 Jul. 9, 2015

(30) Foreign Application Priority Data

Jul. 16, 2012 (NO) ..... 20120813

(51) Int. Cl.
*E21B 25/08* (2006.01)
*E21B 47/01* (2012.01)
(Continued)

(52) U.S. Cl.
CPC ..... *E21B 25/08* (2013.01); *E21B 47/00* (2013.01); *E21B 47/01* (2013.01); *E21B 47/12* (2013.01)

(58) Field of Classification Search
None
See application file for complete search history.

(56) References Cited

U.S. PATENT DOCUMENTS 3,548,958 A 12/1970 Blackwell et al.
5,360,074 A * 11/1994 Collee ..... C09K 8/60 175/226

(Continued)

FOREIGN PATENT DOCUMENTS

GB 2318372 A 4/1998

OTHER PUBLICATIONS

International Search Report issued in PCT/EP2013/063867 dated Jul. 22, 2014 (3 pages).

(Continued)

*Primary Examiner* — Shane Bomar
(74) *Attorney, Agent, or Firm* — Osha Liang LLP

(57) ABSTRACT

A technology is described of a system capable of altering between extracting a core sample from, or drilling of, a downhole subterrain formation. In coring mode the core is encapsulated downhole at in-situ conditions with a material capable of providing a pressure tight seal around the core, protecting the core and temporary storing the core downhole in an inner string for later retrieval. In drilling mode the unwanted sections of the core is grinded away and the material discarded. No tripping to surface is required to change the composition of the drillstring to alter between drilling mode and coring mode. Downhole sensor technology and intelligence is used to distinguish between areas of interest where the core is encapsulated and kept, and areas of no interest where the core is discarded.

27 Claims, 4 Drawing Sheets

(51) Int. Cl.
*E21B 47/00* (2012.01)
*E21B 47/12* (2012.01)

(56) References Cited

U.S. PATENT DOCUMENTS 5,482,123 A 1/1996 Collee
5,546,798 A * 8/1996 Collee ..... E21B 25/08 175/59
5,568,838 A 10/1996 Struthers et al.
5,881,825 A 3/1999 Collee et al.
5,984,023 A 11/1999 Sharma et al.
2001/0000393 A1 4/2001 Collee et al.
2002/0033281 A1 3/2002 Aumann et al.
2002/0129937 A1 9/2002 Cravatte
2006/0243455 A1* 11/2006 Telfer ..... E21B 21/103 166/386
2006/0278389 A1* 12/2006 Ayoub ..... C09K 8/508 166/250.1
2007/0235199 A1* 10/2007 LoGiudice ..... E21B 17/1028 166/386
2009/0139768 A1* 6/2009 Castillo ..... E21B 25/10 175/50
2011/0253452 A1 10/2011 Beuershausen et al.
2013/0068940 A1* 3/2013 Jones ..... E21B 47/102 250/253

OTHER PUBLICATIONS

Written Opinion of the International Searching Authority issued in PCT/EP2013/063867 dated Jul. 22, 2014 (5 pages).
International Preliminary Report on Patentability from PCT/EP2013/063867 dated Dec. 17, 2014 (16 pages).
Norwegian Search Report issued in Patent application No. 20120813 dated Feb. 13, 2013 (2 pages).

* cited by examiner

INTELLIGENT CORING SYSTEM

The present invention relates generally to drilling and coring of subterrain formations. More specifically the invention relates to a method and apparatus for cutting a core and encapsulating it downhole for later analysis.

BACKGROUND OF THE INVENTION

The process of coring subterrain formations typically involves drilling down to the point of interest with a conventional drilling assembly including a drill bit, this is well known in the art. The depth where coring is to commence is typically determined by analyzing drill cuttings collected at surface from the drilling process and/or results from logging sensors that are used to measure formation properties during the drilling process, known as Measurement While Drilling (MWD) systems. The drill cuttings are transported to the surface by means of the return mud flow, this may typically take 30 minutes or more. The sensors of the MWD system, typically capable of measuring natural radiation from the formation, i.e. Gamma Ray this is a parameter of natural gamma radiation of the formation, and electrical conductivity, i.e. Resistivity which is a parameter of inverted electrical conductivity of the formation, is placed some distance behind the drill bit. This means that both sources of information represent formation that has already been drilled, so the uppermost part of the formation that is wanted to be cored is quite often missed.

Once the point of interest is determined, it is typically pulled out of the drilling hole to replace the drilling assembly with a coring assembly. The coring assembly, consisting of a hollow core bit and an inner string for collecting the core is run into the drilling hole and coring of the formation of interest is carried out. Upon completion of the coring process, the core assembly is pulled out of the drilling hole to retrieve the inner string containing the core. Subsequently, a new coring assembly is run in the drilling hole to continue coring, or a drilling assembly is run in the drilling hole to revert to drilling mode, where no core is collected. The complete process includes minimum two roundtrips from the bottom of the drilling hole to surface to first pick up and run a coring assembly for coring, then to change back to a drilling assembly for drilling. This takes substantial time and also increase risk of the wellbore conditions to deteriorate, giving potential problems as drilling continue.

It would be desired from a time, cost and wellbore quality point of view to be able to both cut and preserve the core without having to trip the bottom hole assembly out of the wellbore after coring is completed. One relevant coring system has been described in U.S. Pat. No. 5,568,838 on a Bit-stabilized combination coring and drilling system. In this system a specially designed combination drilling and coring bit including a retrievable center plug is used to alternate between drilling and coring modes. After coring, the core is retrieved by lowering a catch mechanism on a wireline inside the drillpipe, engaging the top of the core barrel and retrieving the core assembly by means of the wireline. This has the advantage of not requiring a roundtrip to surface with the coring assembly. However, it still requires lowering the wireline down to the core barrel and pulling out to retrieve the core at surface. This takes time and also has limitations if the borehole inclination (i.e. the angle of borehole relative to vertical) is high, thus limiting the ability of the wireline assembly to travel to the bottom of the wellbore by its own weight. Also this method represent a risk that the core assembly may get stuck and the wireline broken during the retrieval process, or not being able to engage the core with the wireline catch mechanism, both resulting time consuming operations to retrieve the core and revert to drilling mode.

Furthermore, during normal coring operations the core is cut and subsequent retrieved by tripping the coring assembly all the way out of the drilling hole to surface. During the trip to surface the core will be subject to lower pressures and temperatures. This causes gases and liquids present within the core to bleed out of the core sample. Vital information about the chemical material within the core is lost as it escapes from the core during transport to surface, and the core sample will not be representative of the downhole formations from where it was cut.

Pressure core systems have been developed where the core is collected in a core barrel which is sealed off after the core is cut to provide a pressure-tight seal prior to retrieving the core to surface. It may involve a self-contained high pressure nitrogen gas supply with a controlled expansion of an accumulator compartment to maintain approximate formation pressure (a parameter of the virgin pressure of the formation), trapped in the pressure-tight compartment of the barrel, ref. U.S. Pat. No. 3,548,958 issued to Blackwell et al. Pressure core systems typically also include flushing of the core, either on surface or downhole, with the disadvantage of potentially contaminating the core with the flushing fluid. Furthermore, handling of the core at surface both include risk due to the pressure contained within the mechanical compartment and the requirement of freezing the core and maintaining it in a frozen state during transport to the laboratory.

One such pressure core system also include a non-invading gel as is described in U.S. Pat. No. 5,482,123 issued to Baker Hughes Incorporated. The non-invading gel will reduce the invasion of mud filtrate into the core during the coring process. As the non-invading gel is not pressure tight it will not be capable of fully preventing material from within the core of escaping as pressure is lowered during travel from downhole to the surface, and only partly be capable of preserving the core in a relatively pristine state. Also, as the core barrel needs to be filled with the non-invading gel prior to running it in the drilling hole, the amount of non-invading gel relative to the volume of the core after it has been cut may be substantial. For instance, if it is planned to cut a 10 meter core, but only 1 meter core is cut prior to it for operational reasons need to be retrieved, the volume of non-invading gel that may interact with the core is substantial. Also, the non-invading gel surrounds the core material during the whole process of cutting the core, while the current invention encapsulate the core during or after the coring process is completed, minimizing the time allowed for interaction between the core and the non-invading gel.

The present invention relates to a method and apparatus for overcoming shortcomings of prior art when cutting and retrieving a core to be analyzed.

The method and apparatus for cutting a core and encapsulating it for later analysis is described by receiving the core in a core barrel, encapsulating the core at downhole conditions with a material capable of providing a pressure tight seal around the core, temporary storing the core downhole within the core barrel and subsequently retrieving the core at the surface for analysis, later referred to as the coring mode. Furthermore the invention includes sensor technology for measuring the characteristics of the core downhole during the coring process, transmitting said information to surface for analysis and using said information to identify sections of the core that is required to be collected, encapsulated, stored and subsequently retrieved for analysis. The system may include downhole intelligence to allow said identification of wanted core intervals to be determined downhole. Last the invention includes apparatus for grinding away unwanted core material of formations of no interest and removing the same by discharging this material in the return mudflow, later referred to as the drilling mode.

The present invention can be used for all or any operations where a subsurface core sample is required.

SUMMARY OF THE INVENTION

The present invention is described by a method for coring of a subsurface formation. The method is defined by:

- running a coring system comprising a core barrel and a hollow core bit, an inner tube for collecting wanted sections of core material, and coring said subsurface formation, and
- encapsulating said wanted core with a chemical substance in fluid form downhole.

Further features of the inventive method are defined in the claims.

The present invention is also defined by an apparatus for coring of a subsurface formation comprising means for encapsulating the core downhole to provide a pressure tight seal and where said means comprises:

- a core barrel and a hollow core bit for cutting of the subsurface formation,
- an outer core barrel assembly including an outer core string with coupling means to the drill string at the top and the core bit at the bottom, and
- an inner core string with coupling means to the outer core string, with a core catcher to prevent the core from falling out, with a closing system for closing the top of the core barrel, with an encapsulation system for encapsulating the core after it has been cut, and with a storage capacity for storing encapsulated cores downhole until they are retrieved.

Further features of the apparatus are defined in the claims.

The invention allows altering between drilling and coring mode without the need to alter the downhole assembly, and encapsulating the core to provide a pressure tight seal.

DETAILED DESCRIPTION

The present invention will now be described in detail with reference to the figures in which.

Figure 1:
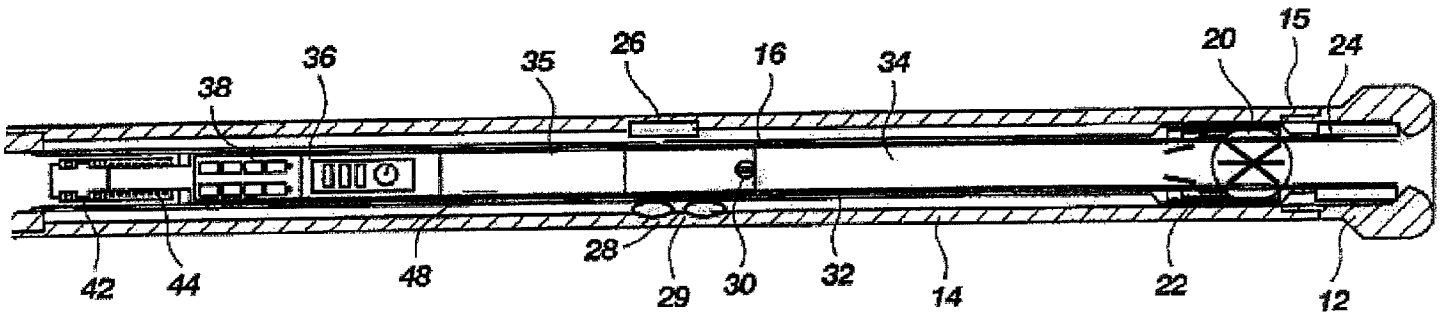
FIG. 1 is a side view of a general drawing outlining the main elements of the intelligent coring system.
Figure 3A:
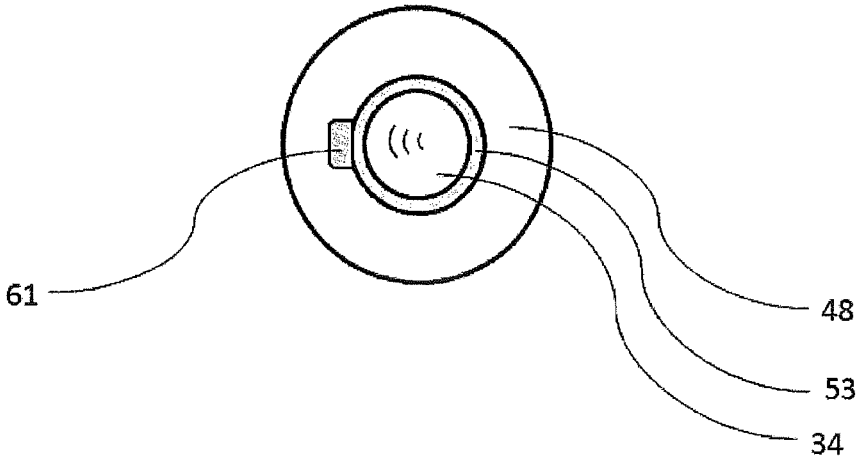
Figure 3B:
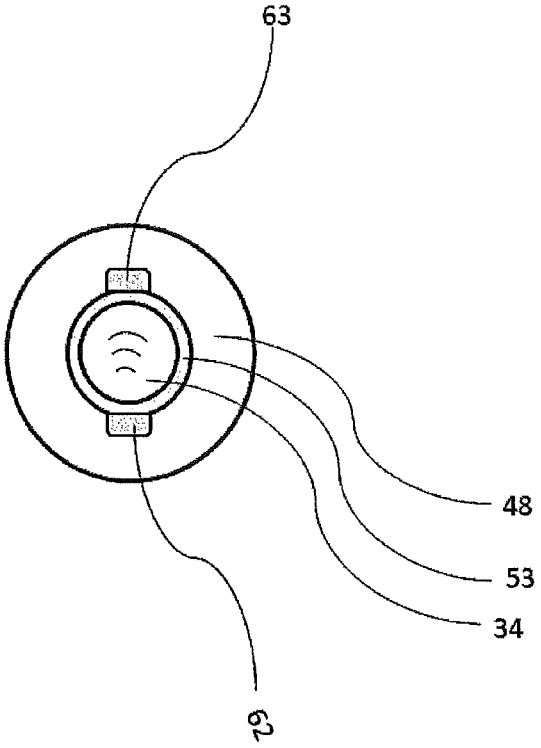
Figure 3C:
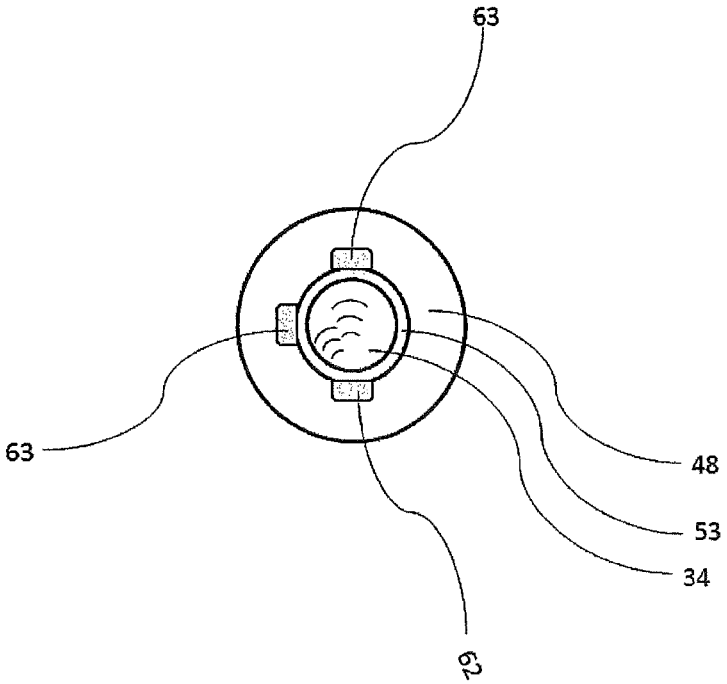
Figure 4A:
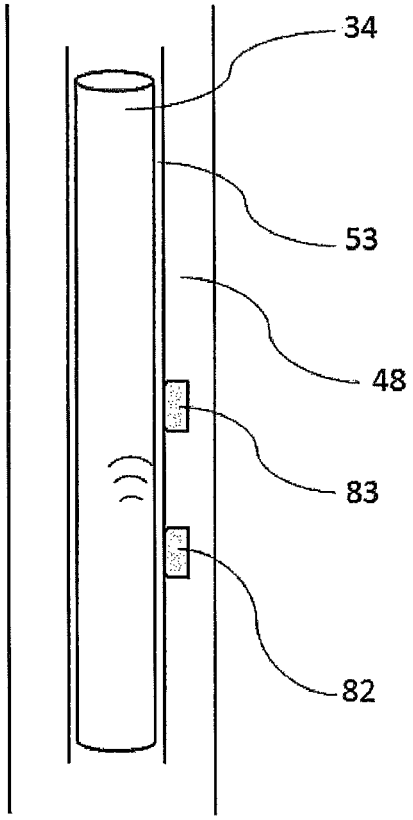
Figure 4B:
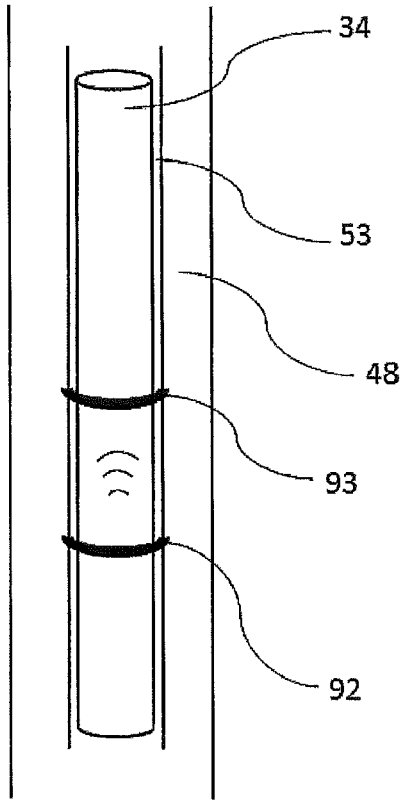

FIG. 3*a* is a cross section of the measurement while coring sensor device at position 24 in FIG. 1;

FIG. 3*b* is a cross section of the measurement while coring sensor device at position 24 in FIG. 1;

FIG. 3*c* is a cross section of the measurement while coring sensor device at position 24 in FIG. 1;

FIG. 4*a* is a profile section of the measurement while coring sensor device at position 24 in FIG. 1, and FIG. 4*b* is a profile section of the measurement while coring sensor device at position 24 in FIG. 1.

FIG. 1 is a side view of a general drawing outlining the main elements of the Intelligent Coring System. The main components are Core Bit 12, Measurement While Coring (MWC) sensor device 24, Measurement While Coring electronics device 15, Core grinder 20, Core catcher 22, Outer housing 14, Core (not encapsulated) 34, Encapsulation material (after encapsulation) 32, Top cover 16, Top cover valve and pressure sensor means 30, Encapsulation material reservoir (chemical component 1) 29, Encapsulation material reservoir (chemical component 2) 28, Encapsulation material mixer and pump unit 26, Core (encapsulated) 35, Inner core string 48, Hydraulic pressure accumulator 36, Electrical power accumulator 38, Electrical generator 44, Mud driven turbine 42.

Figure 2:
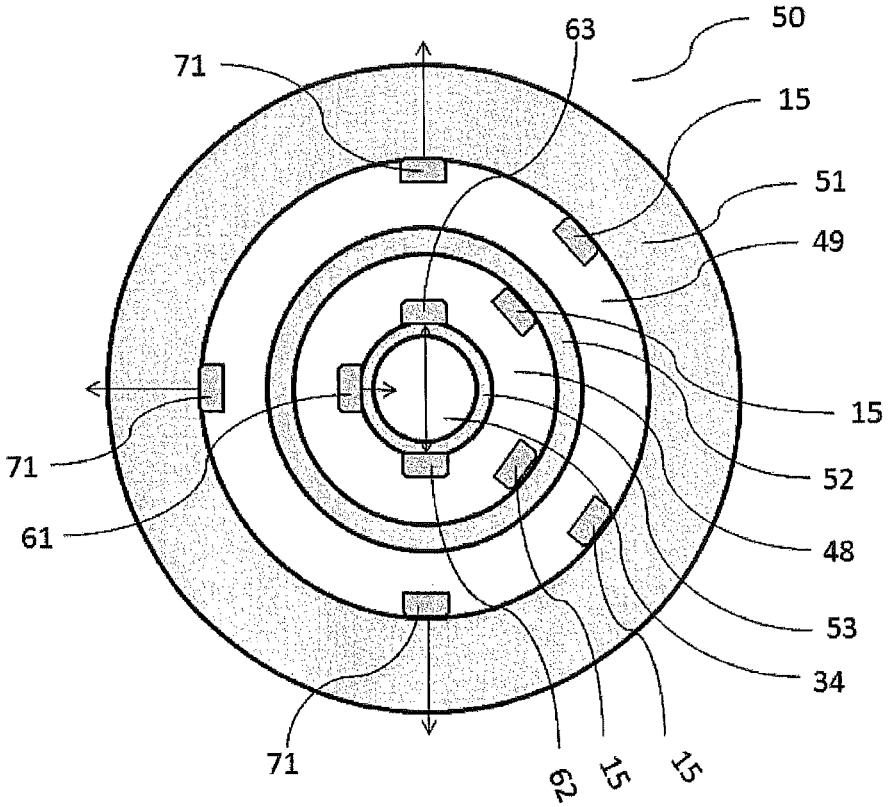
FIG. 2 is a cross section of the measurement while coring sensor device at position 24 in FIG. 1.

FIG. 2 is a cross section of the Measurement While Coring sensor device at position 24 outlining the main elements of the measurement while coring sensor device 24. The main components are Formation surrounding the borehole 50, Annulus between outer core string and borehole wall 51, Outer core string 14, Annulus between inner core string and outer core string 52, Inner core string 48, Annulus between inner core string and core 53, Core (not encapsulated) 34, Measurement While Coring electronics device 15, Measurement While Coring sensor receiver 61 (designed to measure inwardly into the core), Measurement While Coring sensor transmitter 62 (designed to measure across the core), Measurement While Coring sensor receiver 63 (designed to measure across the core), Measurement While Coring sensor device 71 (designed to measure outwardly across the annulus 51 and into the surrounding formation).

FIG. 3*a* is a cross section of the Measurement While Coring sensor device at position 24 outlining the main components of a Measurement While Coring sensor device where the sensor is a detector measuring a natural property of the core. The main components are Inner core string 48, Annulus between inner core string and core 53, Core 34 (not encapsulated), Measurement While Coring sensor receiver 61 (designed to measure inwardly into the core).

FIG. 3*b* is a cross section of the Measurement While Coring sensor device at position 24 outlining the main components of a Measurement While Coring sensor device where the sensor comprise a signal transmitter and a signal receiver measuring a property of the core across the core in a radial direction. The main components are Inner core string 48, Annulus between inner core string and core 53, Core (not encapsulated) 34, Measurement While Coring sensor transmitter (designed to measure across the core) 62, Measurement While Coring sensor receiver (designed to measure across the core) 63.

FIG. 3*c* is a cross section of the Measurement While Coring sensor device at position 24 outlining the main components of a Measurement While Coring sensor device where the sensor comprise a signal transmitter and two signal receivers measuring a property of the core across the core in a radial direction, with the distance from the transmitter to the two receivers being different. The main components are Inner core string 48, Annulus between inner core string and core 53, Core (not encapsulated) 34, Measurement While Coring sensor transmitter (designed to measure across the core) 62, Measurement While Coring sensor receivers (designed to measure across the core) 63.

FIG. 4*a* is a side view of the Measurement While Coring sensor device at position 24 outlining the main elements of a Measurement While Coring sensor device where the sensor comprise a point like signal transmitter and a point like signal receiver measuring a property of the core, along the core in a longitudinal direction. The main components are Inner core string 48, Annulus between inner core string and core 53, Core (not encapsulated) 34, Measurement While Coring sensor transmitter (designed to measure along the core) 82, Measurement While Coring sensor receiver (designed to measure along the core) 83.

FIG. 4*b* is a side view of the Measurement While Coring sensor device at position 24 outlining the main elements of a Measurement While Coring sensor device where the sensor comprise a ring like signal transmitter and a ring like signal receiver measuring a property of the core along the core in a longitudinal direction. The main components are Inner core string 48, Annulus between inner core string and core 53, Core (not encapsulated) 34, Measurement While Coring sensor transmitter (designed to measure along the core) 92, Measurement While Coring sensor receiver (designed to measure along the core) 93.

The data obtained from downhole core samples is essential for geologists, petro-physicists and reservoir engineers in order to analyze, describe and understand the subterrain formations. In order for the data obtained from the analysis of the core to have significance, the core must be representative of the reservoir rock, including the fluids within the core at reservoir conditions. A core barrel including a core bit 12, an outer core string 14 and an inner core string 48 is used to cut a downhole core 34 from subterrain formation 50.

Encapsulation material is prepared either on surface or within the downhole coring system and subsequent to the completion of the coring process either pumped from surface or from a downhole reservoir or downhole mixing means 26 within the coring system to fully encapsulate the core 35. When subject to the pressure and temperature conditions at the core, the material undergo a reaction to transform from a fluid state to a solid state, thus providing a pressure tight seal 32 around the core. In the preferred embodiment the encapsulation material is mixed and the core 34 encapsulated while it is being cut in a continuous process. The encapsulated core sample will prevent any fluid or pressure from escaping when raised to surface and thus retain all material and pressure within the core. At or close to the surface, the top cover 16 with the top cover valve and pressure sensor means 30 of the encapsulated core sample may be connected to an apparatus at site for bleeding of the pressure, collect and analyze the core sample's chemical content and mechanical integrity, including the material retrieved in the process of bleeding of the pressure within the core. Alternatively the core sample is placed in a pressure container and transported to a laboratory for analysis.

Furthermore, after the core has been cut and encapsulated downhole, the core may be temporary stored downhole in an inner core string 48 within the coring system. The core will be preserved and protected within the system and on a later trip to the surface retrieved from the coring system. A core catcher 22 is included to prevent the core from falling out of the core string prior to encapsulation is performed.

The composition of the encapsulating material of the present invention will vary depending upon characteristics of the formation to be cored. For example, a highly permeable formation will require a highly viscous material so that the encapsulating material will not invade the formation of the core. In contrast, a tighter formation with lower permeability will not require such a viscous encapsulating material because the tendency of the material to invade the formation will be reduced. One of the most important factors influencing the composition of the encapsulating material will be temperatures and pressures encountered downhole at the point where the sealing encapsulation process is taking place. The encapsulating material could be comprised of any number of materials that are capable of increasing viscosity and/or solidifying under the particular conditions to be experienced downhole.

A grinding means 20 may be included to remove unwanted core material such as formations of no interest for coring. The grinding means will remove unwanted core material by grinding or drilling it into small pieces of rock that can be discharged into the return mud flow and thus removed from the core. In this way drilling may resume after coring by using a combination of a core bit and a grinding means, thus eliminating the need to trip to surface to change from a coring assembly with a core bit to a drilling assembly with a drill bit. With the combination of the technologies to encapsulate the core downhole, temporary store the core within the coring system, and selectively alter between coring and drilling modes within the same system, no trips will be required to drill subterrain formations and obtain cores of selected intervals as required.

As previously described a core catcher 22 is included to prevent the core from falling out of the core string after it has been cut. Furthermore, the grinding means 20 is capable of grinding away unwanted core material. In the preferred embodiment, said grinding means 20 will also function as a core catcher. Upon completion of the process of cutting a core, the grinding means 20 will be activated, thus cutting off the core at its position. This will prevent the core from falling out of the core string if the core string is lifted from the bottom of the drilling hole. Also, this will prevent excess encapsulation material from being used as it would otherwise fill empty space below the bottom of the core.

Also within the systems may be sensors capable of measuring certain parameters or characteristics of the subterrain formation and the coring system during the coring process. Sensors may be placed both internally within the assembly means to measure said characteristics of the core during the coring process and externally on the assembly to measure same said characteristics of the surrounding formations during the coring process. Measuring such parameters is known in the art as Measurement While Drilling (MWD) technology. Typical formation logging sensors is including, but not limited to; Gamma Ray, Resistivity, Neutron Porosity (which is a parameter of hydrogen index of the formation), Density (a parameter of electron density of the formation), Acoustic (a parameter of shear and compressional wave travel times), Formation Pressure, Magnetic Resonance (a parameter of specific quantum mechanical magnetic properties of the atomic nucleus commonly expressed as the T2 spectrum to identify the fluid type, estimate saturation levels, permeability, and in-situ fluid viscosity), Temperature and Wellbore Pressure. Correlating said measured parameters logged by time with other logged time versus depth information will provide a depth based log of the same formation or core characteristics. By correlating the formation log created from the sensors external on the assembly to a log of similar sensors measuring the same characteristics of the core internal to the assembly, a correlation log whereby any absent coring material or cored interval may be identified will be provided.

During conventional coring the point of interest where coring is to commence is typically decided by analyzing the drilled cuttings that return with the mud flow to surface and/or measurements from downhole sensors within the drilling assembly, previously referenced to as MWD sensors. As the drill cuttings will take substantial time to travel to surface and the MWD sensors are placed some distance behind the drilling bit, both sources of information represent evidence of what has been drilled already, and this information will be lagging the front of the drillbit in both time and depth. Consequently vital information may be lost as quite often the upper part of where coring was wanted to be started has been drilled away already before a decision to stop for coring could be made. Consequently this important interval is drilled and not cored, and therefore lost as no core is obtained. The present invention may in principle core the entire interval. Sensors placed immediately in vicinity of the core bit where the core enters the assembly may be included and provides said vital measurement information of the downhole formations during coring, which again allows a decision to be made to keep and preserve the logged core, or to grind away and discard the same interval. This allows the vital information about the downhole formations from the sensors to be analyzed first, before making a decision to either keep or discard the relevant cored interval. The result will be that all and any interval of interest may be kept and preserved, while all and any interval of no interest may be discarded on basis of the downhole sensor information, with no requirement to trip out of the hole to change equipment to alter between drilling and coring modes.

Means for embedding time and date information in the preserved core may be included if MWC sensors are included. It is of vital importance to correlate said time data to the depth where the measurement is performed. This correlation is done by comparing time and depth data logged at surface during the coring process with the time data stored within the core. This time information may be stored by embedding markers or time capsules within the core during the coring process, prior to encapsulating the core, where said time information can be retrieved on surface by scanning the core to record the information from the time capsules. The time and depth data from the core may be used to provide a depth versus core log, and again correlated to the time and/or depth based log for the downhole sensors that has been transmitted to surface during the coring process. Communication with the MWC sensors, signal processing of sensor information, power supply means, time tracking, control of all devices within the Intelligent Coring System and communication to and from surface is provided and controlled by the MWC electronics device 15.

Altering between modes of keeping or discarding the cored material can be done automatically by the downhole apparatus by including intelligence that analyze the formation characteristics from downhole sensor information and based on pre-determined set of parameters decides to either keep or discard the cored material. By including such downhole intelligence the system may be capable of altering between modes of keeping or discarding cored intervals automatically, including situations where said logging sensor information is not transmitted to surface.

A two-way communication system may be included to be able to send information from the downhole Intelligent Coring system to surface, and vice versa. Information to be sent from the downhole system to surface may include, but not be limited to; information from the downhole sensors measuring the formation characteristics, information from other downhole sensors measuring properties of the Intelligent Coring system, the wellbore, the static and dynamic parameters of the system in the wellbore, directional information, information and status of the coring system such as total interval cored and preserved, status and wear characteristics of the grinding mechanism, remaining volumes of encapsulation material, remaining room for storing encapsulated cores, etc. Information to be transmitted from surface to the downhole system may include, but not be limited to; commands to start the encapsulation process, commands to change between coring and drilling modes, commands to start or stop the grinding system, commands to start specific logging operations such as performing a formation pressure measurement, or commands to transmit to surface various information about system performance, diagnostics and status. Such two-way communication system could include a variety of different communication means, including but not limited to; information sent as pressure signals in the drilling mud, or electrical, microwave, electromagnetic or other signal through the drillstring or parts thereof, or fiber optic, electrical or other signal through a cable or conduit running through the system, or electromagnetic or other signal from the drillstring through the earth.

Traditional MWD technology includes sensors placed on the outer circumference of the MWD tool collar. The sensors 71 are measuring in an outwardly directed direction through the annular space 51 between the sensor and the formation which is typically filled with drilling mud, and finally into the formation 50. As drilling is typically done with higher pressure within the borehole than the surrounding formations, this overpressure causes fluid from the drilling mud to invade the pristine formation. Consequently, MWD sensors are constructed to be able to read far into the formation, beyond both the drilling mud contained in the annular space between the sensor and the borehole wall, and the invaded zone. The deeper into the formation the sensor reads, the poorer the vertical resolution of the measurement will be. A larger annular space and distance between the sensor and the formation of interest also negatively affect the accuracy of the measurement, especially in terms of vertical resolution.

The present invention may include Measurement While Coring (MWC) sensors 24 placed internally and measuring inwardly into the core, immediately after the core has been cut. This means the core will be less invaded as fluid invasion is also a function of time. The sensors can be placed immediately in vicinity of the core material, with no or minimal drill fluid filled annular space 53 in between. This means the MWC sensors can be constructed differently with other characteristics than traditional MWD sensors that measure outwardly. Most significantly, the sensors only need to have a very small distance of investigation, as the core itself is only typically 5-10 cm in diameter. The present invention includes various sensors capable of measuring certain characteristics of the cored formation. These sensors may include, but not be limited to; sensor measuring natural radiation of the formation (Gamma Ray) by means of a GR detector, sensor measuring electrical conductivity (Resistivity) of the formation by means of electromagnetic wave transmitter(s) and receiver(s), sensor measuring Neutron Porosity by means of a neutron source/emitter and detector(s), sensor measuring Bulk Density by means of a gamma ray source/emitter and detector(s), sensor measuring acoustic shear and compressional travel times by means of acoustic transmitter(s) and receiver(s), sensor measuring formation pressure by means of isolating a part of the core and performing a pressure drawdown and observing the pressure build up to virgin formation pressure, NMR sensor measuring quantum mechanical magnetic properties of the atomic nucleus commonly expressed as the T2 spectrum by means of magnetic resonance to identify the fluid type, saturation levels, permeability and in-situ fluid viscosity. Temperature, wellbore pressure, drilling dynamics and other sensors may also be included, as well as a directional sensor device capable of measuring borehole inclination relative to earth horizontal plane, borehole azimuth relative to earth north and tool face orientation (orientation of directional sensor relative to its own axis) by means of an accelerometer and magnetometer device or gyroscopic instruments.

The invention includes the capability of using the material intended for encapsulation of the core to seal off zones where drilling mud is lost to the formation, known in the art as lost circulation zones. If a weak zone is penetrated with the drillbit, not capable of withstanding the pressure within the borehole, drilling mud will be lost into this weak zone. In order to seal off this weak zone, the encapsulation material may be mixed and pumped through the corebit into the weak zone and seal the weak zone while solidifying. Drilling or coring may be resumed after the encapsulation material has solidified and sealed the weak formation.

In the present invention power to the system is generated downhole by means of a turbine 42 and generator 44 driven by the mudflow, which is pumped through the drillstring from surface. Also included are accumulators capable of storing and provide electrical power 38 to allow operation of the system in cases where drilling mud is not pumped from surface, and/or pressure accumulators 36 capable of storing and provide pressure for operating the encapsulation material mixer and pump unit 26 for downhole mixing of the encapsulation material 28 and 29 with or without pumping drilling mud from the surface. The power generation system may be placed higher up in the system with mud returns significantly separated from the MWC sensor device and the encapsulation means to minimize influence of the mud on both measurements and the quality of the core prior to encapsulation.

As the encapsulated core contains the original fluids and pressures from downhole it may represent a safety risk when brought to surface. The present invention includes means for backing off and retrieving the upper sections of the coring apparatus, above the encapsulated cores. The top of each section of encapsulated core may include a sealing top cover 16 with a connection point and a valve 30, as seen in FIG. 1. A surface system may be connected to said connection point to bleed off the pressure within the encapsulated core and collect all fluids that escape during the bleed off process for analysis of its content and composition. From a safety point of view it would be advantageous to connect to and drain the core when the core is brought close to the surface, but is still within the uppermost parts of the wellbore/riser system, and therefore not physically on surface. A stabbing apparatus which is connected to and essentially is part of the surface system may be run into the core string and connected to said connection point of each encapsulated core, to perform said draining process of each core prior to bringing the core all the way to surface.

The present invention presents several advantages. A combined drilling and coring system is designed which enables altering between drilling and coring modes without the need to trip the assembly out of the drilling hole to alter between the modes of operation, and without the need to pause the operation to retrieve the core by means of fishing it out of the drill string by the use of a wireline retrievable core assembly. This saves significant time when trips to surface are saved.

In the present invention, the core is encapsulated and preserved during or immediately after coring and may be retrieved by pulling the coring assembly out of the wellbore prior to commencing drilling, or preferably be stored in an inner string within the combination coring and drilling assembly and retrieved at a later stage after drilling is completed or operations otherwise dictate. The quality of the core sample will be preserved during transport to the surface as no fluids will escape during the process of raising the core from downhole conditions to surface conditions. This will increase the quality of the core and improve the accuracy of interpretations and analysis of the core data, thus resulting in a more accurate reservoir description.

The coring system may include Measurement While Coring (MWC) sensors providing vital information of the formation characteristics of the cored material as it is being cored. This information may be used to decide which sections of the core is of interest and will be encapsulated and preserved, and which sections are of no interest and can be discarded. Furthermore, the decision to keep or discard cored material may be made before the core is encapsulated or grinded away, thus ensuring all relevant and interesting core material can be kept. This is in contrast to conventional methods where typically some distance of the uppermost section of the wanted core is lost as the information used to decide when to core is lagging the drillbit in time and distance. Consequently all interesting and relevant formation can be collected and cored with the present invention. Also, when using a conventional system, coring tend to continue after formations of interest has been passed as no MWC coring information is typically available. So not only are important intervals missed, quite often also undesired intervals are obtained.

Downhole intelligence may be built into the system to automate the process of keeping or discarding cored material, based on the measurements obtained by the downhole formation sensors. This will speed up the decision process and enable the system to function even if transmission of information to and from the surface is unavailable.

The design of the system will enable MWC sensors to be placed much closer to the formation of interest as these sensors may measure on the core directly, and measure/sense inwardly. The sensors can be made smaller and more compact. Certain measurements will also be much less demanding when measured around a core as opposed to being measured from the outer circumference of the MWD tool and through an annular space and into the formation. This will enable more straightforward logging sensors to be constructed. One such example is the Magnetic Resonance tool, which may be built in a form closer to its origin from medical science, as opposed to the complex design of existing logging tools that have to be made in order to overcome the unfavorable logging conditions external on an MWD tool.

As the MWC sensors measure different characteristics of the core and have different modes of operation, the design of the individual sensors may differ depending on said mode of sensor operation. Providing MWC sensors are included in the apparatus, their preferred design will be described as follows:

In the preferred embodiment the gamma ray sensor is a detector measuring natural radiation of the formation in close vicinity of the core, measuring across the core, as described in FIG. 3*a*. Here the gamma ray sensor is represented as item 61. It is understood that there may be more than one gamma ray detector.

In the preferred embodiment the neutron porosity sensor includes a point like neutron emitter and one or more point like neutron receivers, placed in close proximity to the core and measuring across the core as described in FIGS. 3*b* and 3*c*. Here the emitter would be item 62 and the receivers are items 63. In an alternative embodiment the neutron porosity sensor includes a point like neutron emitter and one or more point like neutron receivers, placed in close proximity to the core and measuring along the core as described in FIG. 4*a*. Here the emitter would be item 82 and the receiver item 83.

In the preferred embodiment the density sensor includes a point like gamma emitter and one or more point like gamma receivers, placed in close proximity to the core and measuring across the core as described in FIGS. 3*b* and 3*c*.

Here the emitter would be item 62 and the receivers are items 63. In an alternative embodiment the density sensor includes a point like gamma emitter and one or more point like gamma receivers, placed in close proximity to the core and measuring along the core as described in FIG. 4*a*. Here the emitter would be item 82 and the receiver item 83.

In the preferred embodiment the acoustic sensor includes a point like sound wave transmitter and one or more point like sound wave receivers, placed in close proximity to the core and measuring across the core as described in FIGS. 3*b* and 3*c*. Here the transmitter would be item 62 and the receivers are items 63. In an alternative embodiment the acoustic sensor includes a point like sound wave transmitter and one or more point like sound wave receivers, placed in close proximity to the core and measuring along the core as described in FIG. 4*a*. Here the transmitter would be item 82 and the receiver item 83.

In the preferred embodiment the resistivity sensor includes one or more ring like electromagnetic wave transmitters and one or more ring like electromagnetic wave receivers placed in close proximity to the core as described in FIG. 4*b*, measuring along the core. Here the transmitter would be item 92 and the receiver item 93. In an alternative embodiment the sensor includes one or more point like electromagnetic wave transmitters and one or more point like electromagnetic wave receivers placed in close proximity to the core as described in FIGS. 3*d* and 3*c*, measuring across the core. Here the transmitter would be item 62 and the receiver items 63.

In the preferred embodiment the nuclear magnetic resonance sensor includes one or more ring like magnetic resonance emitters and one or more ring like magnetic resonance receivers placed in close proximity to the core as described in FIG. 4*b*, measuring along the core. Here the transmitter would be item 92 and the receiver item 93. In an alternative embodiment the sensor includes one or more point like magnetic resonance emitters and one or more point like magnetic resonance receivers placed in close proximity to the core as described in FIGS. 3*b* and 3*c*, measuring across the core. Here the transmitter would be item 62 and the receiver items 63.

In the preferred embodiment the formation pressure sensor includes means for isolating a surface area of the core by pressuring two sealing elements each providing a pressure tight seal around the total outer 360 degree circumference of the core, spaced some distance apart, to provide an isolated annulus as described in FIG. 4*b*. Here the sealing elements would be items 92 and 93. A formation pressure tester apparatus (not included in drawing) is in communication with said isolated annulus and measures formation pressure by providing a drawdown of the pressure within said isolated annulus and allowing the pressure to build up to the virgin formation pressure within the core. In an alternative embodiment means for isolating a surface area of the core is provided by pressuring a sealing pad against the wall of the core, and where this sealing pad includes a conduit for pressure and fluid communication between the core and the formation pressure sensor apparatus as described in FIG. 3*a*. Here the sealing element would be item 61.

From the description of FIGS. 2, 3*a*, 3*b*, 3*c*, 4*a* and 4*b* above it is understood that:

- there may be one or more sensors comprising a passive recording device, such as a Gamma Ray detector;
- there may be one or more signal transmitters and one or more signal receivers in a configuration of an active sensor, such as a Resistivity sensor, Neutron Porosity sensor, Density sensor, Acoustic sensor or Nuclear Magnetic Resonance sensor;
- Transmitter(s) and Receiver(s) in a sensor configuration may consist of point like devices, such as indicated in the referenced drawings 3*a*, 3*b*, 3*c* and 4*a*, measuring essentially a limited area of the core surface;
- Transmitter(s) and Receiver(s) in a sensor configuration may consist of ring like devices positioned around the inner circumference of the inner core string, such as indicated in the referenced drawing 4*b*, measuring essentially around the circumference of the core;
- both point like and ring like Transmitter(s) and Receiver(s) may be positioned radially to each other, as per the referenced drawings, measuring radially inwardly or across the core;
- both point like and ring like Transmitter(s) and Receiver(s) may be positioned longitudinally to each other, measuring essentially inwardly and along the core, and
- a combination of point like Transmitter(s) and ring like Receiver(s) is possible, both in a radial and/or longitudinal configuration, and
- a combination of ring like Transmitter(s) and point like Receiver(s) is possible, both in a radial and/or longitudinal configuration, and
- there may be one or more transmitters or one or more receivers for each sensor configuration.

The invention claimed is:

1. A method for coring of a subsurface formation comprising:

- running a coring system comprising an outer core string, a hollow core bit for coring said subsurface formation, an inner core string for collecting of core material,
- measuring formation parameters including properties of the cored material by downhole sensors, and
- using said formation measurements to determine if sections of the cored material is to be kept or discarded.

2. The method according to claim 1, wherein the cored material to be discarded is grinded away with a core grinder and discharged to the return mudflow.

3. The method according to claim 2, further comprising encapsulating the core material that is to be kept after the cored material to be discarded is grinded away, and where said encapsulating is performed downhole with a chemical substance in fluid form making a pressure tight seal.

4. The method according to claim 1, wherein said downhole sensors measuring formation parameters are placed in close proximity to the core bit and measures said formation parameters prior to a decision is made for keeping or discarding the cored material.

5. The method according to claim 1, wherein information from said downhole sensors measuring formation parameters is transmitted to the surface.

6. The method according to claim 1, wherein information from said downhole sensors measuring formation and other parameters is transmitted to the surface through signals through the earth, in a drillstring, an inner drillstring, a dedicated line by means of electromagnetic signal, electrical signal, wave signal, optical signal or by pressure signals in the drilling mud within or around said drillstring, said inner drillstring or said dedicated line.

7. The method according to claim 1, further comprising embedding time information on the core material during the coring process, and scanning the core material at the surface to record said time information and matching this with corresponding recorded time and depth information logged at surface during coring.

8. The method according to claim 1, wherein a decision to keep or discard cored material is performed by a downhole electronics device based on the information from said downhole sensors measuring formation parameters.

9. The method according to claim 3, wherein said chemical substance in fluid form undergoes a reaction and transforms to a solid state to provide a pressure tight seal around the core.

10. The method according to claim 3, wherein said chemical substance in fluid form is stored in a pressure chamber(s) downhole as part of the coring system, and a reaction is initiated by releasing said fluid downhole and encapsulating said core material, thereby forming a pressure tight seal after solidification.

11. The method according to claim 3, wherein said chemical substance in fluid form undergoes a reaction to solid state by means of a pressure and/or temperature change when said fluid is escaping from its chamber(s) and encapsulating said core material, and where the pressure and/or temperature in said pressure chamber is substantially higher than the pressure and/or temperature of the core, or the pressure and/or temperature in said pressure chamber is substantially lower than the pressure and/or temperature of the core.

12. The method according to claim 3, wherein said chemical substance in fluid form is being created by mixing two or more substances that undergo a chemical reaction to form a solid state substance.

13. The method according to claim 3, wherein said chemical substance in fluid form is mixed on surface and pumped down to the core system through a drillstring, or an inner drillstring or a dedicated line for transporting said fluid to the core system downhole.

14. The method according to claim 3, wherein said chemical substance in fluid form is mixed downhole as part of the coring system by releasing one or more chemical components from a separate chamber(s) to a main chamber.

15. The method according to claim 3, wherein said chemical substance in fluid form is mixed downhole as part of the coring system by releasing one or more chemical components from separate chamber(s) to encapsulate said core material, and where one of the chemical components are already surrounding the core material during the coring process.

16. The method according to claim 3, wherein the mixing of said chemical substance in fluid form may be performed by a downhole mixing apparatus.

17. The method according to claim 15, wherein the amount of respective two or more fluid components to be released from their respective chamber(s) is controlled from surface or is controlled by a downhole electronics device.

18. The method according to claim 3, wherein said chemical substance in fluid form is mainly a polymer chain type that changes composition when said pressure and/or temperature change is initiated to form longer polymer chains and thereby undergoing a process to enter a solid state from its initial fluid state.

19. The method according to claim 9, wherein the solidification process of a chemical substance in fluid form is a result of the type and concentration of said two or more components to match the downhole temperature and pressure conditions at the position of the core material when encapsulation is performed.

20. The method according to claim 3, wherein the amount of material required to fully encapsulate the core material is minimized by means of a piston at the top of a core barrel, and by moving said piston downwards within the core barrel to the top of the core after the coring process is complete, or pushing the piston upwards with the top of the core to prevent the entire volume of the core barrel above the core from having to be filled with said encapsulation material.

21. The method according to claim 20, wherein said piston is moved down to the top of the core by means of pumping mud from surface or by means of pumping from a hydraulic reservoir within the coring system.

22. The method according to claim 20, wherein said piston is equipped with a top cover with a connection point and a valve where a surface system may be connected to said connection point before or after the core barrel is raised to surface to enable to bleed off the pressure within the encapsulated core and collect all fluids that escape during the bleed off process for analysis of its content and composition.

23. An apparatus for coring of a subsurface formation, comprising:

an outer core string, a hollow core bit for coring said subsurface formation, an inner core string for collecting of core material;

downhole sensors for measuring formation parameters including properties of the cored material;

a downhole electronic device for controlling and communicating with the downhole sensors, and for analysing the cored material to determine if sections of the cored material is to be kept or discarded based on measured formation parameters;

a core grinder for grinding away the cored material to be discarded; and one or more fluid communication channels allowing said core material that is grinded off to be discharged to the return mudflow.

24. The apparatus according to claim 23, further comprising a chemical substance in fluid form for encapsulating core material in a pressure tight seal after the discarded material has been grinded away.

25. The apparatus according to claim 23, further comprising:

an encapsulation system with one or more chamber(s) capable storing chemical components of said chemical substance for encapsulating the core material a mixing apparatus capable of mixing said chemical components, a pump and fluid distribution system capable of encapsulating said core material, and a pressure chamber capable of storing hydraulic pressure to operate said mixing and pump apparatus.

26. The apparatus according to claim 23, further comprising:

a power source for providing electrical power to the sensor device, an electronic device for controlling and communicating with the sensors, a memory within the electronics device for recording measurements and time information, and a communication system for transmitting said measurement characteristics and time information to the surface and receiving control information from the surface.

27. The apparatus according to claim 26, further comprising:

means for embedding the time information at appropriate locations of the core material representing the time it was measured.

* * * * *